United States Patent [19]

Blum

[11] 4,186,513

[45] Feb. 5, 1980

[54] TOY NURSING BOTTLE

[75] Inventor: Seymour Blum, Rockville Center, N.Y.

[73] Assignee: H-G Toys, Inc., Long Beach, N.Y.

[21] Appl. No.: 918,871

[22] Filed: Jun. 26, 1978

[51] Int. Cl.[2] ..... A63H 13/02

[52] U.S. Cl. ..... 46/1 D; 46/141

[58] Field of Search ..... 46/1 D, 11, 41, 141

[56] References Cited

U.S. PATENT DOCUMENTS

| | | | |
|---|---|---|---|
| 1,692,938 | 11/1928 | Jacobs | 46/1 D |
| 2,039,373 | 5/1936 | Whittmann | 46/1 D |
| 3,071,888 | 1/1963 | Knott | 46/1 D |
| 3,105,324 | 10/1963 | Friedman | 46/1 D |
| 3,105,325 | 10/1963 | Gardel et al. | 46/1 D |
| 3,245,174 | 4/1966 | Gardel et al. | 46/1 D |

FOREIGN PATENT DOCUMENTS

| | | | |
|---|---|---|---|
| 699656 | 12/1964 | Canada | 46/1 D |

*Primary Examiner*—Charles E. Phillips

*Attorney, Agent, or Firm*—Seidel, Gonda, Goldhammer & Panitch

[57] ABSTRACT

Toy nursing bottle includes inner and outer shells spaced from one another with the space containing a fluid to simulate milk or other fluid. Flow of the fluid from the space between the shells to a hollow cap on the outer shell is by way of a notch on one of the juxtaposed surfaces of the shells. Frothing of the fluid is minimized by ribs on opposite sides of the notch.

7 Claims, 4 Drawing Figures

TOY NURSING BOTTLE

BACKGROUND

Toy nursing bottles have been proposed heretofore. A liquid simulating milk or other fluid is provided in the annular space between inner and outer shells. A cap is attached to the outer shell and communicates with the space between the shells by way of a notch or restricted passageway. When the bottle is inverted and the simulated milk enters the cap, the air from the cap escapes into the space between the shells in a rapid, non-uniform manner which causes the simulated milk to froth.

Representative prior art are U.S. Pat. Nos. 3,105,324; 3,071,888; 2,039,373; 3,105,325; and Canadian Patent No. 699,656. While such patents deal with the problem of air escaping from the cap in a variety of different manners, none to my knowledge solves the problem of frothing. The present invention is a solution to the frothing problem.

SUMMARY OF THE INVENTION

The present invention is directed to a toy nursing bottle having inner and outer shells with a space therebetween. A cap is attached to one end of the outer shell. At least one notch is provided on one of said shells to communicate the interior of the cap with the space between the shells. A pair of ribs is provided on one of said shells adjacent to and on opposite sides of said notch. One end of each rib is adjacent one end of each notch and the distance between the ribs is at least as great as the distance across the notch.

It is an object of the present invention to provide a toy nursing bottle wherein a liquid is prevented from frothing by controlling and directing air flow and liquid flow from a cap to an annular space between inner and outer shells by means of ribs as described herein.

It is another object of the present invention to provide a control means for controlling frothing of a simulated milk liquid in a manner which is simple, inexpensive and reliable.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail, wherein like numerals indicate like elements, there is shown a toy nursing bottle designated generally as 10.

Figure 1:
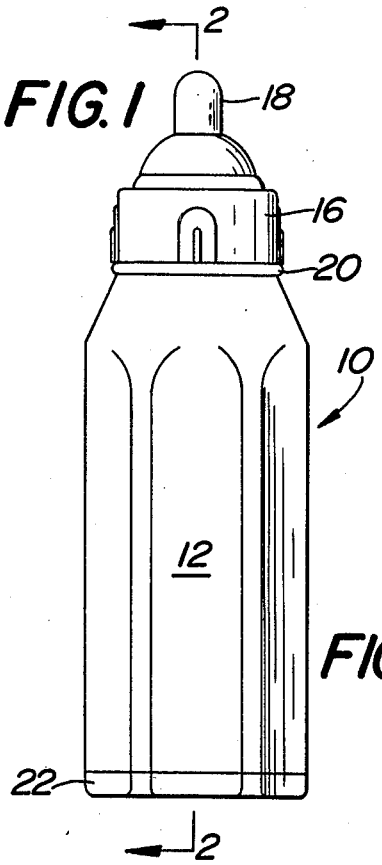
FIG. 1 is an elevation view of a toy nursing bottle in accordance with the present invention.
Figure 2:
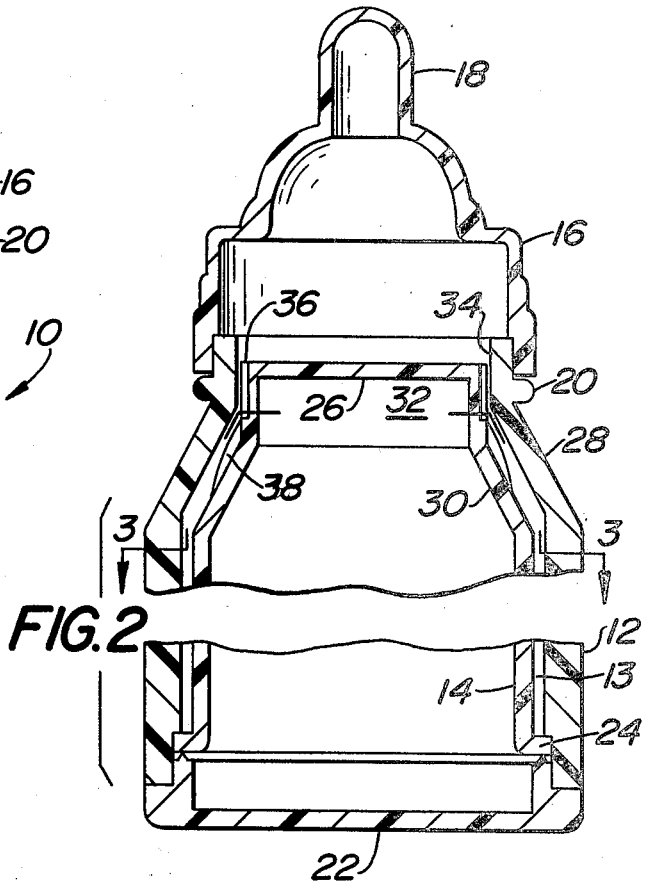
FIG. 2 is a sectional view taken along the line 2—2 in FIG. 1 and on an enlarged scale.

The toy nursing bottle 10 includes an outer shell 12 and an inner shell 14. The shells 12 and 14 are preferably made from a transparent polymeric plastic material such as high impact polystyrene. Other polymeric plastics which are transparent may be used. As shown by comparison on FIGS. 1 and 3, the outer shell 12 has a cylindrical inner surface and an octagonal outer surface. The outer surface of shell 12 need not be octagonal but may be of other shapes.

An annular space 13 is provided between the shells 12 and 14. A cap 16 with a simulated nipple 18 is attached to the open upper end of the outer shell 12 in any convenient manner such as by threads or a force-fit or by gluing. Cap 16 is preferably attached to the outer shell 12 above the bead 20 on the outer shell 12.

The inner shell 14 is open at its lower end and provided with a radially outwardly directed flange 24. Flange 24 extends into a notch adjacent the lower end of the outer shell 12 and is secured in place by way of a end cap 22. End cap 22 is fixedly secured in a telescopic relationship with the outer shell 12 and retains the inner shell 14 in the illustrated disposition. The upper end of inner shell 14 is closed by an end wall 26.

The outer shell 12 has a tapered portion 28 below bead 20 and an axially directed cylindrical portion 34 above bead 20. The inner shell 14 is similarly constructed with a tapered portion 30 juxtaposed to the tapered portion 28 and an axially directed portion 32 juxtaposed to portion 34.

Figure 4:
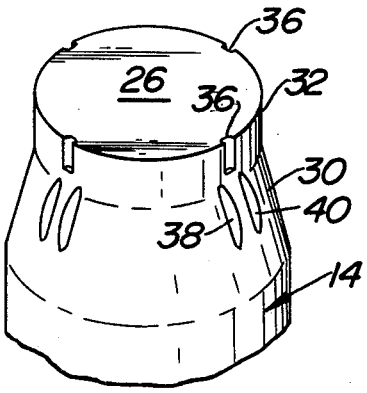
FIG. 4 is a partial perspective view of the upper end of the inner shell.

One of the portions 32, 34 is provided with a notch to provide communication between space 13 and the interior of the cap 16. As illustrated in FIG. 4, the notch is provided on the portion 32. Preferably, a plurality of notches 36 are provided. While four such notches 36 are provided on the inner shell 14, a greater or lesser number may be provided as desired.

The notch 36 is disposed entirely on the outer periphery of portion 32 and has an axial length which is less than the axial length of portion 32. It will be noted that portions 32 and 34 only partially overlap. The length of notch 36 is sufficient so as to be opposite the upper end of the tapered portion 28.

Figure 3:
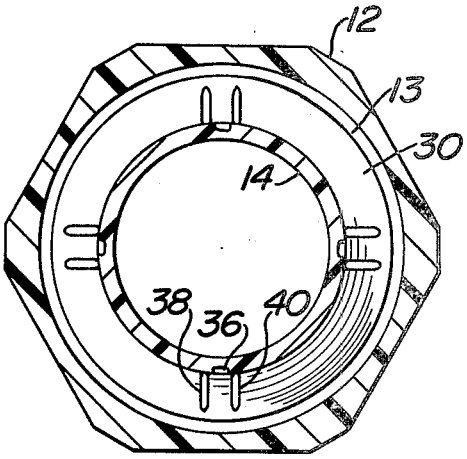
FIG. 3 is a sectional view taken along the line 3—3 in FIG. 2.

Each of the notches 36 is provided with a froth dissipating means. Since each of the froth dissipating means are identical, only one will be described in detail. Referring to FIGS. 3 and 4, notch 36 is provided with a pair of ribs 38, 40. The distance between the ribs is at least as great as the width of the notch 36. The upper end of the ribs is approximately at the lower end of the notch 36. By way of example, the ribs are 1/32 inch wide, 3/16 inch long, and project outwardly for a distance corresponding to about ¾ of the radial dimension of space 13 in the zone of the tapered portions 28, 30. The lower end of the ribs 38, 40 is above the lower end of tapered portions 28, 30.

When the bottle 10 is turned upside down, a liquid simulating milk in space 13 will flow into the cap 16. Air from the cap 16 will be channeled as a stream in the space between the ribs 38, 40 whereby the air does not form excessive bubbles in the liquid and causes the same to froth.

While the notch and ribs are shown on the outer periphery of the inner shell 14, they may instead be provided on the inner periphery of the outer shell 12.

The present invention may be embodied in other specific forms without departing from the spirit or essential attributes thereof and, accordingly, reference should be made to the appended claims, rather than to the foregoing specification, as indicating the scope of the invention.

I claim:

1. A toy nursing bottle comprising inner and outer shells separated by an annular space, a cap on said outer shell, the interior of said cap communicating with the space between the shells by at least one notch on at least one of the shells, a pair of ribs on one of said shells, said ribs being adjacent to and on opposite sides of said notch, one end of each rib being adjacent one end of said notch, the distance between the ribs being at least as great as the distance across the notch.

2. A toy nursing bottle in accordance with claim 1 wherein said notch and ribs are on the outer peripheral surface of said inner shell.

3. A toy nursing bottle in accordance with claim 2 wherein said inner and outer shells are tapered adjacent the upper end thereof, said shells being cylindrical above said taper, said notch being on a cylindrical portion of said inner shell above the tapered portion thereof, said ribs being on the tapered portion of the inner shell.

4. A toy nursing bottle in accordance with claim 3 wherein said inner shell has a plurality of notches uniformly spaced apart with each notch having a pair of said ribs associated therewith.

5. A toy nursing bottle comprising inner and outer shells with a space therebetween, each shell being cylindrical at the upper end thereof and then tapering outwardly therefrom, the inner shell being closed at its upper end and having its cylindrical portion at least partially overlapping and closely fitted to the cylindrical portion of the outer shell, a cap attached to the upper end of said outer shell, one of said juxtaposed cylindrical surfaces having a notch providing communication between said space and the interior of said cap, and means including a rib on opposite sides of said notch for minimizing frothing of a liquid as it passes through said notch from said space to the interior of said cap.

6. A toy nursing bottle in accordance with claim 5 wherein said ribs are on the tapered portion of said inner shell and extend downwardly from a location adjacent the lower end of said notch, the distance between said ribs being at least as great as the circumferential width of said notch.

7. A toy nursing bottle in accordance with claim 6 wherein said ribs extend toward the inner peripheral surface on the tapered portion of the outer shell for a distance corresponding to at least one-half the distance between the tapered portions of said shells.

* * * * *